US010400767B2

(12) United States Patent
Miyagawa et al.

(10) Patent No.: US 10,400,767 B2
(45) Date of Patent: Sep. 3, 2019

(54) ELECTRIC PUMP UNIT

(71) Applicant: JTEKT CORPORATION, Osaka-shi (JP)

(72) Inventors: Yasukata Miyagawa, Habikino (JP); Noriyuki Okamoto, Okazaki (JP)

(73) Assignee: JTEKT CORPORATION, Osaka-shi (JP)

( * ) Notice: Subject to any disclaimer, the term of this patent is extended or adjusted under 35 U.S.C. 154(b) by 203 days.

(21) Appl. No.: 14/803,223

(22) Filed: Jul. 20, 2015

(65) Prior Publication Data

US 2016/0025092 A1 Jan. 28, 2016

(30) Foreign Application Priority Data

Jul. 23, 2014 (JP) ..... 2014-149734

(51) Int. Cl.
*F04C 11/00* (2006.01)
*F04C 15/00* (2006.01)
*F04C 2/10* (2006.01)

(52) U.S. Cl.
CPC ..... *F04C 15/0088* (2013.01); *F04C 2/10* (2013.01); *F04C 11/008* (2013.01); *F04C 15/0034* (2013.01); *F04C 15/008* (2013.01); *F04C 2240/54* (2013.01)

(58) Field of Classification Search
CPC ..... F16C 17/02; F16C 33/107
See application file for complete search history.

(56) References Cited

U.S. PATENT DOCUMENTS 2,558,598 A * 6/1951 Wightman ..... F16C 17/026 384/412
2,779,296 A * 1/1957 Dudley ..... F01B 3/0038 417/439
3,201,183 A * 8/1965 Buske ..... F16C 33/06 384/286
3,311,428 A * 3/1967 Scheufler ..... F16C 33/06 384/286
3,625,580 A * 12/1971 DeHart ..... F16C 9/04 384/288

(Continued)

FOREIGN PATENT DOCUMENTS

DE 1 675 066 A1 12/1971
GB 2441413 B * 1/2009 ..... F01C 21/02

(Continued)

*Primary Examiner* — Peter J Bertheaud
*Assistant Examiner* — Geoffrey S Lee
(74) *Attorney, Agent, or Firm* — Oblon, McClelland, Maier & Neustadt, L.L.P.

(57) ABSTRACT

An electric pump unit is provided that ensures capability for lubricating a plain bearing and in which a lubricating oil passage is formed with a simple structure. This pump unit includes: a pump in which a rotor placed in a pump chamber of a pump housing rotates; and an electric motor having a motor shaft coupled to the rotor. The motor shaft is rotatably supported by a cylindrical plain bearing disposed in the pump housing. An oil seal is provided on the opposite side to the pump chamber with the plain bearing between so as to be located between the pump housing and the motor shaft. Oil supply grooves are formed in an inner peripheral surface of the plain bearing so as to extend through the plain bearing in an axial direction.

4 Claims, 3 Drawing Sheets

(56) References Cited

U.S. PATENT DOCUMENTS 3,671,155 A * 6/1972 Dubinsky ..... F01C 21/02 384/398
3,863,996 A * 2/1975 Raimondi ..... F01D 25/164 384/108
3,870,383 A * 3/1975 Morisaki ..... F16C 33/103 184/6.17
3,969,044 A * 7/1976 Fussner ..... F02M 37/08 417/410.4
4,580,951 A * 4/1986 Carleton ..... F02M 37/08 184/30
4,624,630 A * 11/1986 Hirahara ..... F04C 29/028 310/191
4,626,180 A * 12/1986 Tagawa ..... F04C 29/025 184/6.16
4,710,111 A * 12/1987 Kubo ..... F04C 29/023 184/6.16
4,968,233 A * 11/1990 Nakayoshi ..... F04C 2/102 418/166
5,551,852 A * 9/1996 Saito ..... F04C 29/02 418/55.4
5,667,372 A * 9/1997 Hwang ..... F04C 29/028 418/63
6,280,167 B1 * 8/2001 Pahl ..... F04C 2/086 418/171
6,361,293 B1 * 3/2002 Harper ..... F04C 23/008 417/312
6,554,594 B2 * 4/2003 Yamamoto ..... F04C 27/009 418/104
6,769,889 B1 * 8/2004 Raney ..... F04C 2/102 384/278
9,488,226 B2 * 11/2016 Watanabe ..... F16C 33/6655
9,499,194 B2 * 11/2016 Yamada ..... B62D 5/0409
9,506,466 B2 * 11/2016 Ebihara ..... F04C 2/086
9,611,891 B2 * 4/2017 Ishii ..... F16C 33/6614
9,638,190 B2 * 5/2017 Yoshida ..... F01C 21/108
2002/0096838 A1 * 7/2002 Yamamoto ..... F04C 27/009 277/552
2004/0047746 A1 * 3/2004 Rembold ..... F02M 59/06 417/273
2010/0107680 A1 * 5/2010 Ogata ..... F01C 1/3564 62/468
2011/0129370 A1 * 6/2011 Lee ..... F04C 18/322 417/410.1
2011/0293442 A1 * 12/2011 Tatewaki ..... F16H 61/0025 417/279
2013/0315770 A1 * 11/2013 Rhein ..... F04C 2/086 418/61.3
2014/0010647 A1 * 1/2014 Nishida ..... F16C 17/18 415/229
2016/0040670 A1 * 2/2016 Pillis ..... F04C 29/0021 418/88

FOREIGN PATENT DOCUMENTS

JP 60-108799 U 7/1985
JP 62-181 U 1/1987
JP 06-034180 U 5/1994
JP 2005-220798 8/2005
JP 2008057346 A * 3/2008 ..... F01C 21/02
JP 2012-26349 2/2012

* cited by examiner

ELECTRIC PUMP UNIT

INCORPORATION BY REFERENCE

The disclosure of Japanese Patent Application No. 2014-149734 filed on Jul. 23, 2014 including the specification, drawings and abstract, is incorporated herein by reference in its entirety.

BACKGROUND OF THE INVENTION

1. Field of the Invention

The present invention relates to electric pump units.

2. Description of the Related Art

An oil pressure is supplied from a hydraulic pump to an automatic transmission of an automobile. In automobiles that perform what is called "idle reduction" (idle reduction operation) in which an engine is stopped for the purpose of energy saving etc. when the automobile is stopped, an electric hydraulic pump is used in order to ensure supply of an oil pressure to a transmission even during the idle reduction.

An electric hydraulic pump for transmissions of automobiles is mounted in a limited space in a vehicle body. There is a need to make such an electric hydraulic pump compact, and also to reduce the weight and cost of such an electric hydraulic pump. In response to such a need, an electric pump unit is proposed which contains both a pump and an electric motor for driving the pump in a common housing.

For example, an electric pump unit described in Japanese Patent Application Publication No. 2012-26349 (JP 2012-26349 A) uses, as a bearing that supports a motor shaft of an electric motor, a plain bearing rather than a rolling bearing in order to reduce the size. In order to lubricate between the cylindrical plain bearing and the motor shaft, this electric pump unit has a first oil passage extending in the axial direction from a tip end of the motor shaft and a plurality of second oil passages extending from the first oil passage to an outer peripheral surface of the motor shaft. Lubricating oil that is supplied from the tip end of the motor shaft flows through the first oil passage and the second oil passages to lubricate the plain bearing.

In this electric pump unit, however, the oil passages for supplying the lubricating oil to the plain bearing are provided in the motor shaft. It is very difficult and costs a lot to form such oil passages. It is therefore desired to ensure capability for lubricating the plain bearing and to form an oil passage with a simple structure to achieve cost reduction of electric pump units.

SUMMARY OF THE INVENTION

It is an object of the present invention to provide an electric pump unit which can ensure capability for lubricating a plain bearing and in which an oil passage is formed with a simple structure to achieve cost reduction.

An electric pump unit according to one aspect of the present invention includes: a pump that sucks and discharges oil as a rotor placed in a pump chamber of a pump housing rotates while in sliding contact with wall surfaces at both axial ends of the pump chamber; and, an electric motor that has a motor shaft coupled to the rotor and drives the pump. In the electric pump unit, the motor shaft is rotatably supported by a cylindrical plain bearing disposed in the pump housing, a seal member is provided at a position on an opposite side to the pump chamber with the plain bearing between so as to be located between the pump housing and the motor shaft, and an oil supply groove is formed in an inner peripheral surface of the plain bearing so as to extend through the plain bearing in an axial direction.

According to the electric pump unit of the above aspect, part of the oil in the pump chamber flows through an clearance between the wall surfaces at the both axial ends of the pump chamber and end faces of the rotor that is in sliding contact with these wall surfaces, and reaches an end of the oil supply groove. This oil then flows in the oil supply groove in the axial direction and is supplied to the inner peripheral surface of the plain bearing. This oil can ensure capability for lubricating the plain bearing. The oil supply groove can be easily formed by cutting the inner peripheral surface of the plain bearing or performing plastic working on the inner peripheral surface of the plain bearing. In this electric pump unit, the capability for lubricating the plain bearing can be ensured, and cost can be reduced as the oil passage is formed with a simple structure.

BRIEF DESCRIPTION OF THE DRAWINGS

The foregoing and further features and advantages of the invention will become apparent from the following description of example embodiments with reference to the accompanying drawings, wherein like numerals are used to represent like elements and wherein.

DETAILED DESCRIPTION OF EMBODIMENTS

Figure 1:
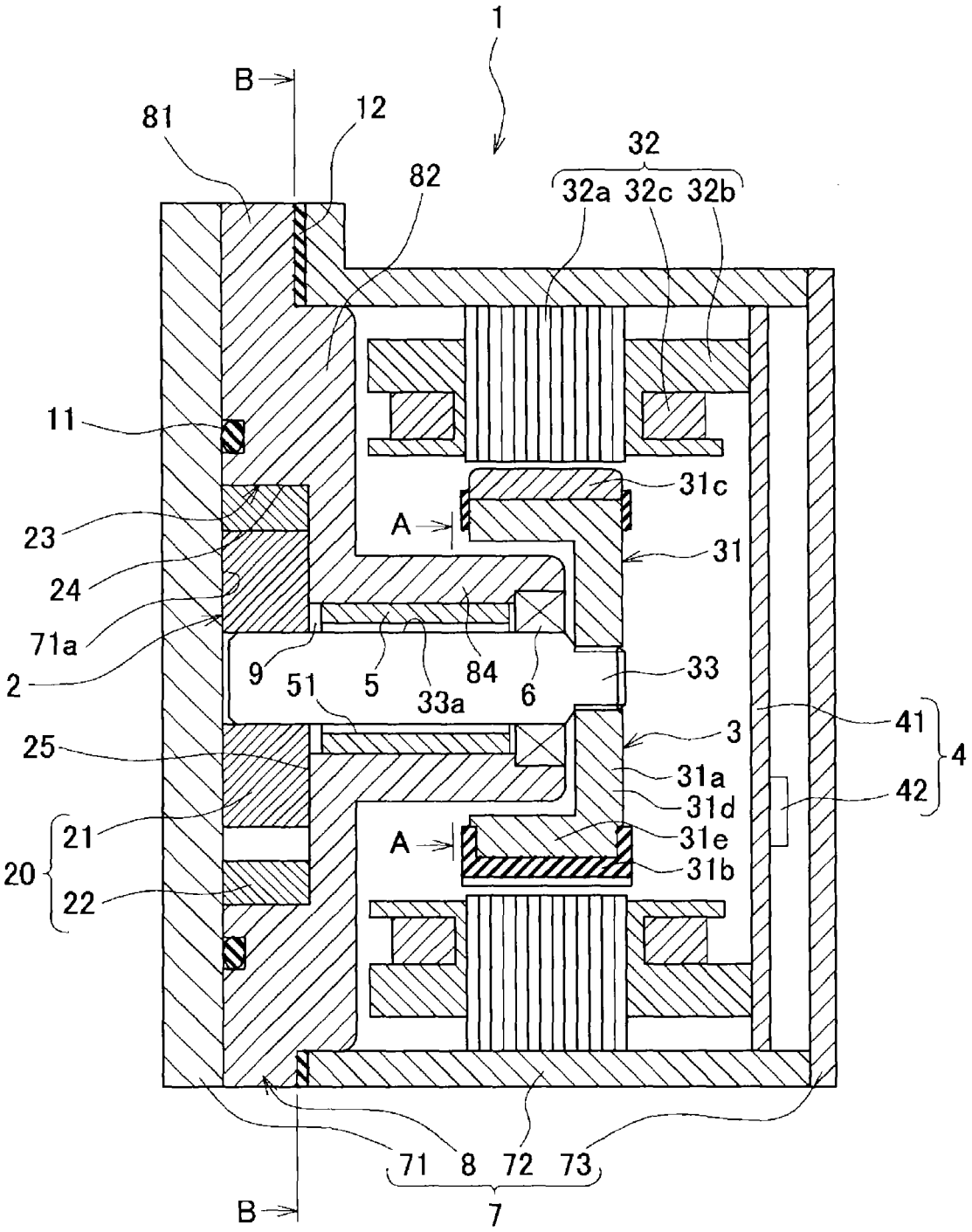
FIG. 1 is a sectional view of an electric pump unit according to an embodiment of the present invention.

An electric pump unit according to an embodiment of the present invention will be described below with reference to the accompanying drawings. In the following description, the left side in FIG. 1 corresponds to the front side, and the right side in FIG. 1 corresponds to the rear side. FIG. 1 is a sectional view of an electric pump unit 1 according to an embodiment of the present invention. As shown in FIG. 1, the electric pump unit 1 for, e.g., a transmission of an automobile contains both a pump 2 and an electric motor 3 for driving the pump 2 in a unit housing 7. In this example, the pump 2 is an internal gear pump, and the electric motor 3 is a direct current (DC) brushless motor having three-phase windings.

The unit housing 7 is formed by a pump plate 71, a pump housing 8, a motor housing 72, and a lid 73.

The pump plate 71 is in the shape of a plate and is attached at a front end of the electric pump unit 1. The pump housing 8 has a thick cylindrical portion that is formed by forming a rear side wall portion 82 integrally with an outer peripheral wall portion 81 so that the rear side wall portion 82 adjoins a rear end of the outer peripheral wall portion 81. The pump housing 8 has an opening in a front end face of the outer peripheral wall portion 81. A rear end face 71*a* of the pump plate 71 is fixed to the front end face of the outer peripheral wall portion 81 via an O-ring 11.

The motor housing 72 is a cylindrical member, and a front end of the motor housing 72 is fixed to a rear surface of the outer peripheral wall portion 81 of the pump housing 8 at a position closer to the outer periphery of the outer peripheral wall portion 81 with a seal member 12 interposed therebetween. An opening in a rear end of the motor housing 72 is closed by the lid 73.

A pump chamber 23 as a substantially columnar recess is formed in a front surface of the pump housing 8 which is closed by the pump plate 71. The pump chamber 23 is a closed chamber that is surrounded by an outer peripheral wall 24 and a rear end wall 25 of the pump housing 8 and the rear end face 71*a* of the pump plate 71. A rotor 20 is rotatably accommodated in the pump chamber 23. The rotor 20 is formed by an inner rotor 21 and an outer rotor 22. The outer rotor 22 has a plurality of internal teeth, and the inner rotor 21 is placed inward of the outer rotor 22 and has a plurality of external teeth meshing with the internal teeth of the outer rotor 22.

The outer rotor 22 rotates while in sliding contact with the outer peripheral wall 24 and the rear end wall 25 of the pump housing 8 and the rear end face 71*a* of the pump plate 71. The inner rotor 21 is fitted on a motor shaft 33 of the electric motor 3, and the inner rotor 21 rotates with its front and rear end faces being in sliding contact with the rear end face 71*a* of the pump plate 71 and the rear end wall 25 of the pump housing 8. A small clearance is provided between the rear end face of the inner rotor 21 and the rear end wall 25 of the pump housing 8. Although not shown in the figure, the pump plate 71 has an oil suction port and an oil discharge port which communicate with the pump chamber 23.

The pump housing 8 has a cylindrical bearing support portion 84 formed integrally with the rear side wall portion 82. The bearing support portion 84 protrudes rearward from the central portion of the rear side wall portion 82. A center hole in the bearing support portion 84 communicates with the pump chamber 23. A cylindrical plain bearing 5 is fitted in the bearing support portion 84. The plain bearing 5 rotatably supports the motor shaft 33 of the electric motor 3. An oil seal 6 (seal member) is fixed to a part of an inner peripheral rear end of the bearing support portion 84 which has an increased inside diameter.

The electric motor 3 includes the motor shaft 33 extending in the longitudinal direction, a motor rotor 31 fixed to a rear part of the motor shaft 33, and a motor stator 32 placed around the motor rotor 31.

The motor stator 32 is formed by attaching an insulator 32*b* to a core 32*a* and winding a stator coil 32*c* around the insulator 32*b*. The core 32*a* is formed by stacked steel sheets. In this example, the motor stator 32 is fixed to the inner periphery of the motor housing 72 by adhesion etc.

The motor shaft 33 is inserted in the bearing support portion 84 of the pump housing 8 so that an intermediate part of the motor shaft 33 is rotatably supported by the plain bearing 5. A front part of the motor shaft 33 protrudes from the bearing support portion 84 of the pump housing 8 and extends into the pump chamber 23, and a front end of the motor shaft 33 is fixed to an inner peripheral surface of the inner rotor 21 by press fitting. The oil seal 6 seals between the bearing support portion 84 and the motor shaft 33 at a position rearward of the plain bearing 5.

The motor rotor 31 is provided so that a substantially cylindrical holding member 31*b* made of a synthetic resin is fixed to the outer periphery of a cylindrical rotor body 31*a*. The holding member 31*b* is shaped to have a plurality of windows at regular intervals in the circumferential direction, and a segment-like permanent magnet 31*c* is held in each window. The rotor body 31*a* is made of, e.g., a sintered metal and is formed in such a shape that a flange portion 31*d* and a cylindrical portion 31*e* are formed integrally. The cylindrical portion 31*e* connects to a region near the outer periphery of a front end face of the flange portion 31*d*. The flange portion 31*d* is fixed to a rear end of the motor shaft 33 by press fitting. The cylindrical portion 31*e* extends inside the motor stator 32 and extends forward so as to surround the motor shaft 33.

A substrate 41 of a controller 4 is fixed to a rear end of the insulator 32*b* of the motor stator 32, and a component 42 of the controller 4 is attached to the substrate 41. Although the component 42 is placed at a predetermined position on at least one of front and rear surfaces of the substrate 41, only one component 42 attached to the rear surface of the substrate 41 is shown in the figure.

An oil supply groove 51 is formed in an inner peripheral surface of the plain bearing 5 so as to extend through the plain bearing 5 in the axial direction. An annular oil storage portion 9 is formed between a front end of the plain bearing 5 and the inner rotor 21.

Figure 2:
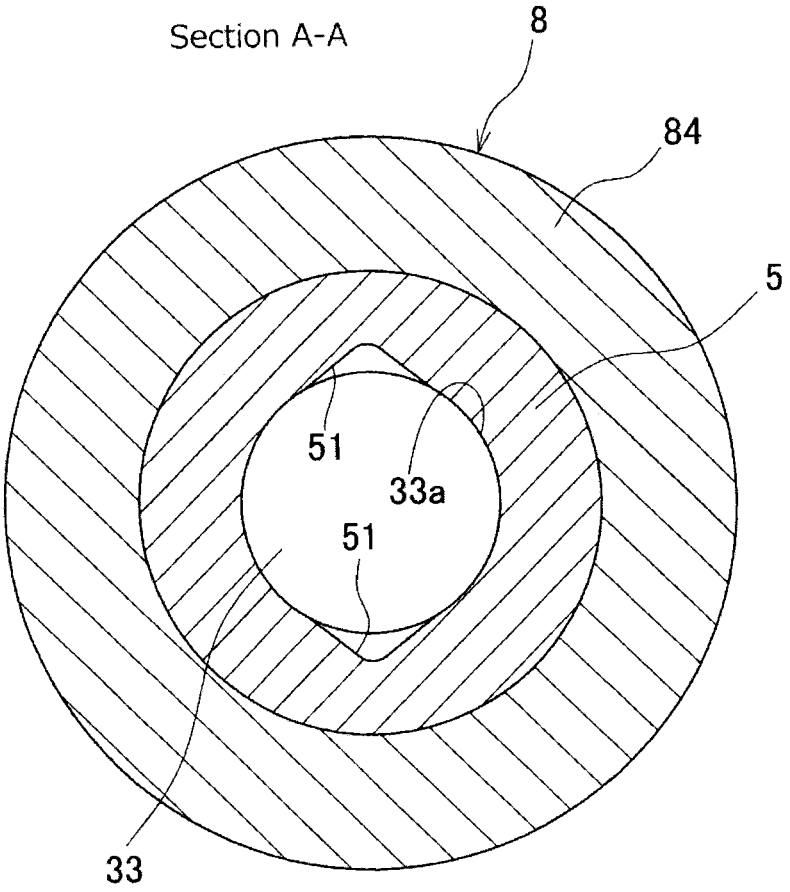
FIG. 2 is a sectional view taken along line A-A in FIG. 1.

FIG. 2 is a sectional view taken along line A-A in FIG. 1. As shown in FIG. 2, the plain bearing 5 is fitted in the bearing support portion 84 of the pump housing 8, and a small clearance is provided between an outer peripheral surface 33*a* of the motor shaft 33 and an inner peripheral surface of the plain bearing 5 so that the plain bearing 5 rotatably supports the motor shaft 33. The oil supply groove 51 is formed at two positions in the circumferential direction in the inner peripheral surface of the plain bearing 5. The plain bearing 5 is a sintered copper alloy, and the oil supply grooves 51 are formed integrally with the plain bearing 5 by molding of green compact or plastic working, etc. The oil supply grooves 51 may be formed by cutting.

Figure 3:
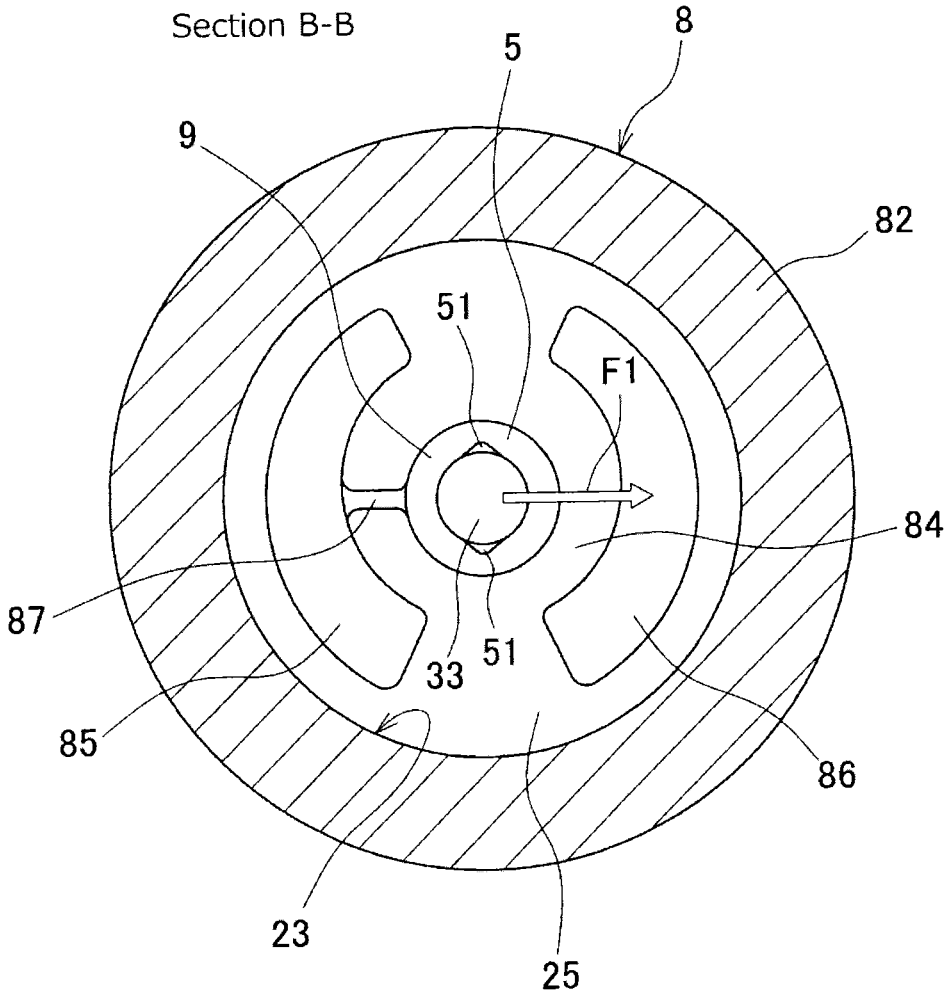
FIG. 3 is a sectional view taken along line B-B in FIG. 1.

FIG. 3 is a sectional view taken along line B-B in FIG. 1. A front surface of the pump housing 8 has a discharge port 85 and a suction port 86 which are recessed from an end face of the rear end wall 25 surrounding the pump chamber 23. The discharge port 85 and the suction port 86 are formed in the shape of an elongated hole that is longer in the circumferential direction. The front surface of the pump housing 8 further has an oil supply passage 87 extending from the middle of the discharge port 85 in the circumferential direction and communicating with the oil storage portion 9. The oil supply passage 87 is formed integrally with the pump housing 8 by molding, plastic working, etc. Although not shown in the figure, the rear end face 71*a* of the pump plate 71 forming the pump chamber 23 has a discharge port and a suction port which are formed similarly to the discharge port 85 and the suction port 86 in the rear end wall 25.

A pumping function of the electric pump unit 1 having the above configuration will be described below. In the electric pump unit 1 shown in FIGS. 1 to 3, the electric motor 3 is stopped and the pump 2 is stopped during traveling of the automobile.

When the automobile is stopped, the electric motor 3 is operated and the pump 2 is operated. When in operation, the pump 2 sucks oil from the oil suction port into the pump chamber 23 through an oil suction pipe etc., not shown, and then discharges the oil from the oil discharge port. The pump 2 thus supplies the oil to desired parts of the transmission via an oil discharge pipe, etc., (not shown).

As the pump 2 is driven by the electric motor 3, the suction port 86 side of the pump chamber 23 serves as a lower oil pressure region, and the discharge port 85 side of the pump chamber 23 serves as a higher oil pressure region. Part of oil having a high oil pressure enters the oil storage portion 9 through the clearance between the rear end wall 25 of the pump chamber 23 and the rear end face of the inner rotor 21 that is in sliding contact with the rear end wall 25, and also enters the oil storage portion 9 from the discharge port 85 through the oil supply passage 87. The oil that has entered the oil storage portion 9 flows in the oil supply grooves 51 in the axial direction and is supplied to the clearance between the inner peripheral surface of the plain bearing 5 and the outer peripheral surface 33*a* of the motor shaft 33. This oil lubricates the plain bearing 5. The oil supplied to the plain bearing 5 does not flow out of the pump housing 8 because the oil seal 6 is located rearward of the plain bearing 5. Although not shown in the figure, the pump housing 8 has a return oil passage extending from an area between the plain bearing 5 and the oil seal 6 and communicating with the suction port 86. The oil having a high oil pressure in the pump chamber 23 lubricates the plain bearing 5 and flows through the return oil passage to return to the pump chamber 23 via the suction port 86.

According to the electric pump unit 1 having the above configuration, part of oil having a high oil pressure in the pump chamber 23 enters the oil storage portion 9 through the clearance between the rear end wall 25 surrounding the pump chamber 23 and the rear end face of the inner rotor 21 and is stored in the oil storage portion 9. The oil thus stored in the oil storage portion 9 is supplied to the clearance between the inner peripheral surface of the plain bearing 5 and the outer peripheral surface 33*a* of the motor shaft 33. The oil stored in the oil storage portion 9 also flows in the oil supply grooves 51 in the axial direction and is supplied from the oil supply grooves 51 to the clearance between the inner peripheral surface of the plain bearing 5 and the outer peripheral surface 33*a* of the motor shaft 33. Since the oil having a high oil pressure is thus stored in the oil storage portion 9, the oil can be stably supplied to the plain bearing 5. Moreover, since the oil flows in the oil supply grooves 51 in the axial direction, the oil can be supplied to the plain bearing 5 in a balanced manner in the axial direction, and capability for lubricating the plain bearing 5 can be ensured.

The oil storage portion 9 can be easily provided by adjusting the axial position of the plain bearing 5 when disposing the plain bearing 5 in the bearing support portion 84. The oil supply grooves 51 can be easily formed by cutting the inner peripheral surface of the plain bearing 5, by performing plastic working on the inner peripheral surface of the plain bearing 5 by using a die, etc.

Since the electric pump unit 1 of the present embodiment has the oil supply passage 87 extending from the discharge port 85 and communicating with the oil storage portion 9, oil in the pump chamber 23 can be stably supplied to the inner peripheral surface of the plain bearing 5, and the capability for lubricating the plain bearing 5 can be ensured. The oil supply passage 87 can be easily formed as it can be formed integrally with the pump housing 8 by plastic working, etc.

In the electric pump unit 1, when the pump 2 is driven by the electric motor 3, the suction port 86 side of the pump chamber 23 serves as a lower oil pressure region, and the discharge port 85 side of the pump chamber 23 serves as a higher oil pressure region. The rotor 20 in the pump chamber 23 is subjected to a force in the radial direction from the higher oil pressure side to the lower oil pressure side, and is therefore slightly moved toward the lower oil pressure side in the radial direction. With this movement of the rotor 20, the motor shaft 33 is slightly tilted toward the suction port 86, namely, toward the lower oil pressure side, in a direction F1 shown by an arrow. Since the pair of oil supply grooves 51 are provided on a straight line extending in a direction perpendicular to the direction in which the motor shaft 33 is tilted, the motor shaft 33 can be reliably prevented from interfering with (being pressed against) the oil supply grooves 51 when tilted. Rotation resistance of the motor shaft 33 therefore is prevented from becoming unstable due to the interference of the motor shaft 33 with the oil supply grooves 51, and the motor shaft 33 can rotate stably. Since the pair of oil supply grooves 51 are provided so as to face each other with the motor shaft 33 being interposed therebetween, oil can be supplied to the inner peripheral surface of the plain bearing 5 in a balanced manner in the circumferential direction, and the capability for lubricating the plain bearing 5 can be ensured.

The present invention is not limited to the above embodiment and can be embodied in various forms without departing from the spirit and scope of the present invention. Although the oil supply passage 87 is provided in the present embodiment, the present invention is not limited to this. For example, the present invention is also applicable to the configuration that does not have the oil supply passage 87.

Although the oil storage portion 9 is provided in the present embodiment, the present invention is not limited to this. For example, the present invention is also applicable to the configuration that does not have the oil storage portion 9.

What is claimed is:

1. An electric pump unit, comprising:

a pump that sucks and discharges oil as a rotor placed in a pump chamber of a pump housing rotates while in sliding contact with wall surfaces at both axial ends of the pump chamber; and an electric motor that has a motor shaft coupled to the rotor and drives the pump; wherein the motor shaft is rotatably supported by a cylindrical plain bearing disposed in the pump housing, a seal member between the pump housing and the motor shaft in a radial direction of the motor shaft, the seal member facing a first axial end of the plain bearing, an annular oil storage portion facing and completely encircling a second axial end of the plain bearing, a suction port through which the oil is sucked and a discharge port through which the oil is discharged are formed in the wall surfaces at the both axial ends of the pump chamber so as to be in a shape of an elongated hole that is longer in a circumferential direction, an oil supply passage that extends from the discharge port located on the plain bearing side of the pump chamber in the radial direction and communicates with the oil storage portion, and a pair of oil supply grooves each formed in an inner peripheral surface of the plain bearing so as to extend through the plain bearing in an axial direction, the pair of oil supply grooves are provided so as to be located on a straight line extending in a radial direction and being perpendicular to a straight line which connects a middle position of the suction port in the circumferential direction and a middle position of the discharge port in the circumferential direction and so as to face each other with the motor shaft being interposed therebetween.

2. The electric pump unit according to claim 1, wherein the pair of oil supply grooves each extend from the annual oil storage portion.

3. The electric pump unit according to claim 1, wherein the annular oil storage portion faces the second axial end of the plain bearing in the axial direction.

4. The electric pump unit according to claim 1, wherein a portion of the oil is supplied to the pair of oil supply grooves from the oil supply passage via the annular oil storage portion, and the portion of the oil is discharged from the pair of oil supply grooves to the suction port.

* * * * *